US008837743B2

(12) United States Patent
Aarts et al.

(10) Patent No.: US 8,837,743 B2
(45) Date of Patent: Sep. 16, 2014

(54) SURROUND SOUND SYSTEM AND METHOD THEREFOR

(75) Inventors: Ronaldus Maria Aarts, Eindhoven (NL); Werner Paulus Josephus De Bruijn, Eindhoven (NL); William John Lamb, Eindhoven (NL); Aki Sakari Harma, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 338 days.

(21) Appl. No.: 13/375,010

(22) PCT Filed: May 31, 2010

(86) PCT No.: PCT/IB2010/052410
§ 371 (c)(1),
(2), (4) Date: Nov. 29, 2011

(87) PCT Pub. No.: WO2010/140104
PCT Pub. Date: Dec. 9, 2010

(65) Prior Publication Data

US 2012/0076306 A1 Mar. 29, 2012

(30) Foreign Application Priority Data

Jun. 5, 2009 (EP) ..... 09162007

(51) Int. Cl.

| | |
|---|---|
| ***H04R 5/00*** | (2006.01) |
| ***H04R 3/14*** | (2006.01) |
| ***H04S 3/00*** | (2006.01) |
| ***H04S 7/00*** | (2006.01) |

(52) U.S. Cl.
CPC *H04S 3/002* (2013.01); *H04R 3/14* (2013.01); *H04S 7/301* (2013.01); *H04S 2420/05* (2013.01); *H04R 2217/03* (2013.01)
USPC ..... 381/17; 381/18; 381/19; 381/307

(58) Field of Classification Search
USPC ..... 381/17–19, 77, 79, 82, 92, 111, 306, 381/307
See application file for complete search history.

(56) References Cited

U.S. PATENT DOCUMENTS 6,807,281 B1 * 10/2004 Sasaki et al. ..... 381/111
7,315,619 B2 1/2008 Marton et al.

(Continued)

FOREIGN PATENT DOCUMENTS

EP 1771039 A2 4/2007
EP 1871143 A1 12/2007

(Continued)

OTHER PUBLICATIONS

F. Joseph Pompei: "Sound From Ultrasound: The Parametric Array as an Audible Sound Source"; Phd Thesis, Massachusetts Institue of Technology, Dept. of Architecture, Program in Media Arts and Sciences, 2002, 132 pages.

(Continued)

*Primary Examiner* — Vivian Chin
*Assistant Examiner* — Friedrich W Fahnert

(57) ABSTRACT

A surround sound system comprises a receiver (301) for receiving a multichannel spatial signal that comprises at least one surround channel. A directional ultrasound transducer (305) is used for emitting ultrasound towards a surface to reach a listening position (111) via a reflection of the surface. The ultrasound signal may specifically reach the listening position from the side, above or behind of a nominal listener. A first drive unit (303) generates a drive signal for the directional ultrasound transducer (301) from the surround channel. The use of an ultrasound transducer for providing the surround sound signal provides an improved spatial experience while allowing the speaker to be located e.g. to the front of the user. In particular, an ultrasound beam is much narrower and well defined than conventional audio beams and can accordingly better be directed to provide the desired reflections. In some scenarios, the ultrasound transducer (305) may be supplemented by an audio range loudspeaker (309).

15 Claims, 6 Drawing Sheets

(56) References Cited

U.S. PATENT DOCUMENTS

| | | | | |
|---|---|---|---|---|
| 7,362,874 | B2 | 4/2008 | Lee et al. | |
| 2003/0215103 | A1 | 11/2003 | Norris et al. | |
| 2005/0207590 | A1 | 9/2005 | Niehoff et al. | |
| 2007/0274541 | A1 * | 11/2007 | Uetake et al. | 381/150 |
| 2009/0010455 | A1 | 1/2009 | Suzuki et al. | |
| 2009/0290064 | A1 * | 11/2009 | Matsumoto et al. | 348/515 |

FOREIGN PATENT DOCUMENTS

| | | | |
|---|---|---|---|
| JP | 2008270858 | A | 11/2008 |
| WO | 2006001401 | A1 | 1/2006 |

OTHER PUBLICATIONS

H. O. Berktay: "Possible Exploitation of Non-Linear Acoustics in Underwater Transmitting Applications"; J. Sound Vib., 1965, vol. 2, No. 4, pp. 435-461.

F. Joseph Pompei: "Sound From Ultrasound: The Parametric Array as an Audible Sound Source"; Phd Thesis, Massachusetts Institute of Technology, Dept. of Architecture, Program in Media Arts and Sciences, 2002, 132 Page Document.

* cited by examiner

SURROUND SOUND SYSTEM AND METHOD THEREFOR

FIELD OF THE INVENTION

The invention relates to a surround sound system, and in particular, but not exclusively to a home cinema surround sound system.

BACKGROUND OF THE INVENTION

In recent years, spatial sound provision from more than two channels has become increasingly popular such as e.g. evidenced by the wide popularity of various surround sounds systems. For example, the increased popularity of home cinema systems has resulted in a surround sound systems being common in many private homes. However, a problem with conventional surround sound systems is that they require a high number of separate speakers located at suitable positions.

For example, a conventional Dolby 5.1 surround sound system requires right and left rear speakers, as well front centre, right and left speakers. In addition, a low frequency subwoofer may be used.

The high number of speakers not only increases cost but also results in reduced practicality and increased inconvenience to users. In particular, it is generally considered a disadvantage that loudspeakers at various positions in front as well as to the rear of listeners are needed. The rear loudspeakers are particularly problematic due to the required wiring and the physical impact they impose on the interior of the room.

In order to mitigate this problem research has been undertaken in order to generate speaker sets that are suitable for reproducing or emulating surround sound systems but using a reduced number of speaker positions. Such speaker sets use directional sound radiation to direct sounds in directions that will result in them reaching the user via reflections from objects in the sound environment. For example, audio signals can be directed so that they will reach the listener via reflections of sidewalls thereby providing an impression to the user that the sound originates to the side (or even behind) the listener.

However, such approaches of providing virtual sound sources tend to be less robust than real sources positioned to the rear of the listener and tend to provide reduced audio quality and a reduced spatial experience. Indeed, it is often difficult to accurately direct audio signals to provide the desired reflections that achieve the desired virtual sound source position. Furthermore, the audio signals intended to be received from the back of the user also tend to reach the user via direct paths or alternative unintended paths thereby degrading the spatial experience.

Hence, an improved surround sound system would be advantageous and in particular a system that will allow facilitated implementation, facilitated setup, a reduced number of speakers, an improved spatial experience, improved audio quality and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided a surround sound system comprising: a circuit for receiving a multi-channel spatial signal comprising at least one surround channel; a directional ultrasound transducer for emitting ultrasound towards a surface to reach a listening position via a reflection of the surface; and a first drive circuit for generating a first drive signal for the directional ultrasound transducer from a surround signal of the surround channel.

The invention may provide an improved surround sound system. In particular, the system may provide a virtual surround sound source without requiring a speaker to be located behind or to the side of the listener and may reduce the number of speakers or speaker positions in the system. An improved virtual surround sound source may be provided as a highly directional ultrasonic signal is used rather than a conventional audio band signal which cannot be controlled to the same degree. The approach may allow a reduced spatial degradation due to unintended signal paths from the directional ultrasound transducer to the listener. For example, the directional ultrasound transducer may be located to the front of the listener but angled away from the listener towards a wall for reflection. In such a scenario, a much reduced and often insignificant amount of sound will be perceived to originate from the actual position of the directional ultrasound transducer. In particular, a much narrower and well defined audio beam for generating the virtual surround sound can be achieved thereby allowing improved control and an improved spatial experience to be generated.

The invention may in many embodiments allow easy operation and implementation. A low cost surround sound system may be achieved in many scenarios.

A surround channel may be any spatial channel which is not a front channel. In particular, it may be any channel which is not a front left channel, a front right channel or a front center channel. A surround channel may specifically be a channel for rendering by a sound source to the side or behind the listener and in particular a channel intended for rendering with an angle of more than 45° relative to a direction to a front center direction (e.g. corresponding to the direction from a listening position to a front center channel speaker position).

The directional ultrasound transducer may be located to the front of the listener. In particular, the directional ultrasound transducer may be located with an angle of less than 45° relative to a direction to a front center direction (e.g. corresponding to the direction from a listening position to a front center channel speaker position). The directional ultrasound transducer may e.g. be located no further sideways than a left front speaker position and a right front speaker position respectively.

In accordance with an optional feature of the invention, the surround sound system further comprises an audio range loudspeaker; and a second drive circuit for generating a second drive signal for the audio range loudspeaker from the surround signal.

This may provide improved performance in many embodiments and may in particular provide improved sound quality in many scenarios. The directional ultrasound transducer and the audio range loudspeaker may cooperate to provide e.g. a better quality sound and/or an increased sound level. The audio range loudspeaker may in many applications in particular provide improved lower frequency audio quality. The directional ultrasound transducer and audio range loudspeaker may cooperate to provide improved combined directionality and audio quality for the surround sound channel.

The sound signal from the directional ultrasound transducer may provide the main spatial cues to the user whereas the audio range loudspeaker may provide improved audio quality by providing a higher quality sound than typically available from a directional ultrasound transducer, especially at low frequencies.

The directional ultrasound transducer and audio range loudspeaker may specifically be co-located. For example, the centers of the directional ultrasound transducer and the audio range loudspeaker may be within 1 meter, or e.g. 50 cm, of each other. The directional ultrasound transducer and audio range loudspeaker may be combined in a single loudspeaker cabinet. In some embodiments, the on-axis directions for the directional ultrasound transducer and the audio range loudspeaker may be at an angle to each other (say more than 10°). This may allow improved direction of the ultrasonic signal towards a surface in order to e.g. reach the listener from the side or rear directions, while providing a more direct path for the signal from the audio range loudspeaker.

The audio range loudspeaker may specifically be a conventional audio speaker, such as an electro-dynamical (typically front firing) loudspeaker. The audio range loudspeaker may specifically have an operating frequency range below 10 kHz. This may specifically be the case for scenarios wherein the audio range loudspeaker is used only for supplementing the directional ultrasound transducer when presenting the surround signal. However, in scenarios, such as when the audio range loudspeaker is also be used for other purposes (such as e.g. presenting a front side channel), the operating frequency range may extend to higher frequencies.

In accordance with an optional feature of the invention, the surround sound system further comprises a delay circuit for introducing a delay of a second signal component of the second drive signal originating from the surround signal relative to a first signal component of the first drive signal originating from the surround signal.

This may provide improved performance and may in particular allow an improved spatial perception by achieving that the surround signal is more clearly perceived to originate from the direction of the ultrasonic signal, i.e. from the reflected direction which typically may be to the side of, back of or above the listener. The delay may specifically be such that the signal from the directional ultrasound transducer is received before the signal from the audio range loudspeaker, thereby providing more spatial cues.

The approach may use the precedence or Haas effect to provide an improved spatial experience and an improved surround sound directional perception while maintaining a high audio quality. The delay may specifically be in the interval from 1 msec to 100 msec.

In accordance with an optional feature of the invention, the delay is no more than 40 msec higher than a transmission path delay difference between a transmission path from the directional ultrasound transducer to the listening position and a direct path from the audio range loudspeaker to the listening position.

This may provide improved performance and may in particular provide a surround signal that is perceived to be a single source in the direction of the received ultrasound signal. Thus, it may allow the directional ultrasound transducer and the audio range loudspeaker to appear as a single loudspeaker positioned in the direction from which the ultrasound signal is received. In some embodiments, improved performance may be achieved for a corresponding relative delay of less than 16 msec, or even less than 5 msec.

In accordance with an optional feature of the invention, the delay circuit is arranged to vary the delay in response to a transmission path delay value, the transmission path delay value being indicative of a delay of a transmission path from the directional ultrasound transducer to the listening position.

This may provide improved performance and may in particular provide a surround signal that is perceived to be a single source in the direction of the received ultrasonic signal. Thus, it may allow the directional ultrasound transducer and the audio range loudspeaker to appear as a single loudspeaker positioned in the direction from which the ultrasonic signal is received. By varying the delay to specifically match the transmission path delay value, an improved spatial and single source perception may be achieved.

The transmission path delay value may e.g. be determined by measurements (e.g. using a microphone at the listening position) or may e.g. be manually calibrated, for example by a user indicating a distance from the audio range loudspeaker to the listening position.

In accordance with an optional feature of the invention, the delay circuit is arranged to vary the delay in response to a sound source position value.

The delay may be varied to adjust the spatial perception to be determined by the signals from both the audio range loudspeaker and the directional ultrasound transducer. In particular, the spatial cues provided by the two signals may be combined to provide a spatial perception of a sound source direction in-between the direction of the audio range loudspeaker and the direction of arrival of the reflected ultrasonic signal.

In accordance with an optional feature of the invention, a first pass-band frequency interval for generating the first drive signal from the surround signal is different than a second pass-band frequency interval for generating the second drive signal from the surround signal.

This may improve audio quality in many scenarios and may in particular be used to provide an improved and more homogenous combined signal to the listener.

In accordance with an optional feature of the invention, an upper cut-off frequency for the first pass-band frequency interval is higher than an upper cut-off frequency for the second pass-band frequency interval.

This may improve audio quality in many scenarios.

In accordance with an optional feature of the invention, the second drive circuit comprises a low pass filter.

This may improve audio quality in many scenarios. In many scenarios, the low pass filter may advantageously have an upper (e.g. 6 dB) cut-off frequency in the interval from 600 Hz to 1 kHz, or in particular in the interval from 750 Hz to 850 Hz.

In accordance with an optional feature of the invention, the second drive circuit is further arranged to generate the second drive signal from a front channel of the multi-channel spatial signal.

This may provide an improved and/or reduced complexity surround sound system in many embodiments. In particular, it may allow a reduced number of speakers to be used as the same speaker may be used for both the front channel and to supplement the directional ultrasound transducer when providing the surround channel. The front channel may specifically be a front left, front right or front center channel.

In accordance with an optional feature of the invention, the surround sound system further comprises means for varying an on-axis direction of the directional ultrasound transducer relative to an on-axis direction of the audio range loudspeaker.

This may provide improved performance in many scenarios and may in particular allow an improved spatial experience by allowing an optimization of the direction of the ultrasound signal to provide the best reflected path while allowing the audio range loudspeaker to e.g. reach the listener by a direct path. The means for varying the on-axis direction may be a circuit for varying the on-axis direction.

In accordance with an optional feature of the invention, the surround sound system further comprises a circuit for receiving a measurement signal from a microphone; and a circuit for adapting a level of a second signal component of the second drive signal originating from the surround signal relative to a first signal component of the first drive signal originating from the surround signal in response to the measurement signal.

This may provide improved performance in many scenarios and may in particular allow an improved audio quality. In particular, it may allow a smoother cross-over between a frequency range predominantly supported by the audio range loudspeaker and a frequency range predominantly supported by the directional ultrasound transducer.

In accordance with an optional feature of the invention, a normalized delay compensated correlation of a second signal component of the second drive signal originating from the surround signal and a first audio signal component of the first drive signal originating from the surround signal is not less than 0.50.

This may provide improved performance and/or reduced complexity in some embodiments. In some scenarios, the first and second signal components may be substantially identical. The delay compensation may specifically compensate for the intentional delay of the second signal component relative to the first signal component. The delay compensation may correspond to finding the highest delay compensated correlation (when varying the delay). The correlation may be normalized relative to the amplitude, power and/or energy of the first and/or second signal components.

In accordance with an optional feature of the invention, the surround sound system further comprises a circuit for receiving a measurement signal from a microphone; and a circuit for adapting an on-axis direction of the directional ultrasound transducer in response to the measurement signal.

This may provide improved performance in many scenarios and may in particular allow an improved spatial experience by allowing an optimization of the direction of the ultrasonic signal to provide the best reflected path to the listener.

According to an aspect of the invention there is provided a method of operation for a surround sound system comprising a directional ultrasound transducer for emitting ultrasound towards a surface to reach a listening position via a reflection of the surface, the method comprising: receiving a multichannel spatial signal comprising at least one surround channel; and generating a first drive signal for the directional ultrasound transducer from a surround signal of the surround channel.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

The following description focuses on embodiments of the invention applicable to a five spatial channel surround sound system. However, it will be appreciated that the invention is not limited to this application but may be applied to many other surround sound systems including for example systems with seven or even more spatial channels.

Figure 1:
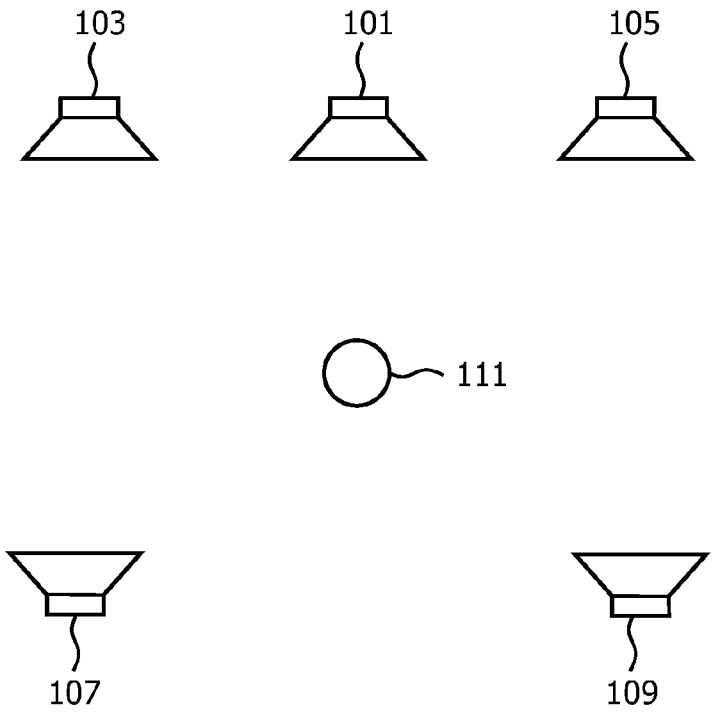
FIG. 1 is an illustration of a speaker system setup for a conventional surround sound system.

FIG. 1 illustrates a speaker system setup in a conventional five channel surround sound system, such as a home cinema system. The system comprises a center speaker 101 providing a center front channel, a left front speaker 103 providing a left front channel, a right front speaker 105 providing a right front channel, a left rear speaker 107 providing a left rear channel, and a right rear speaker 109 providing a right rear channel. The five speakers 101-109 together provide a spatial sound experience at a listening position 111 and allow a listener at this location to experience a surrounding and immersive sound experience. In many home cinema systems, the system may further include a subwoofer for a Low Frequency Effect (LFE) channel.

The requirement for loudspeakers to be located to the side or behind the listening position is typically considered highly disadvantageous as it not only requires additional loudspeakers to be located at inconvenient positions but also require these to be connected to the driving source, such is typically a home cinema power amplifier. In a typical system setup, wires are required to be run from the surround loudspeaker positions 107, 109 to an amplifier unit that is typically located proximal to the front speakers 101, 103, 105. This is particularly disadvantageous for products like home cinema systems which are intended to have a broad appeal and application in environments that are not optimized for or dedicated to the sound experience.

Figure 2:
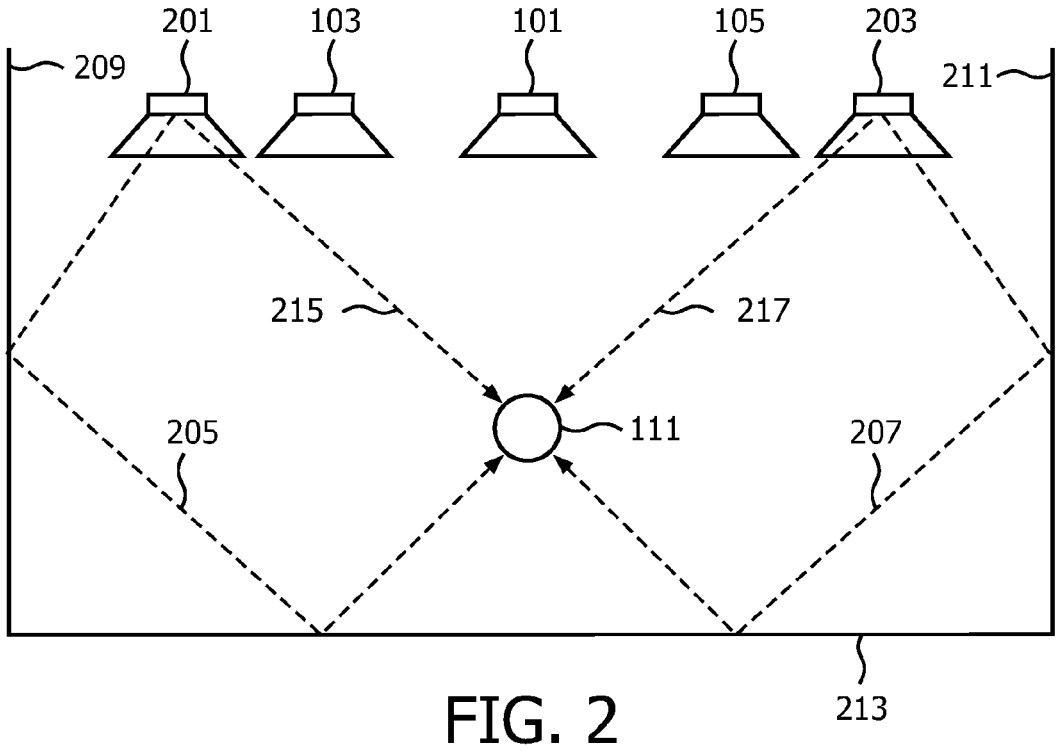
FIG. 2 is an illustration of an example of speaker system setup for a surround sound system in accordance with the invention.

FIG. 2 illustrates an example of a speaker system setup in accordance with some embodiments of the invention. In the example, the front loudspeakers, namely the left front loudspeaker 103, the centre loudspeaker 101, and the right front loudspeaker 105, provide the sound image to the front of the listening position 111. However, in the system of FIG. 2, the surround sound signals are not provided by separate loudspeakers positioned to the rear of the user but are provided by loudspeakers 201, 203 positioned to the front of the listening position 111. In the specific example, a left surround speaker 201 is located adjacent to the left front speaker 103 and a right surround speaker 203 is located adjacent to the right front speaker 105.

In the example, the surround speakers 201, 203 are arranged to radiate a sound signal 205, 207 that is reflected by the side walls 209, 211 and the rear wall 213 to reach the listening position 111 from a direction to the rear of the listener. Thus, the rear surround speakers 201, 203 provide surround signals 205, 207 that appear to the listener to originate from the back. This effect is achieved by radiating the rear sound signals 205, 207 such that they are reflected by the walls 209, 211, 213. In the specific example, the surround sound signals 205, 207 reach the listening position predominantly via two wall reflections, namely of the sidewalls 209, 211 and of rear wall 213. However, it will be appreciated that other embodiments and scenarios may include fewer or more reflections. For example, the surround signals 205, 207 may be radiated to reach the listening position 111 by a single reflection of a side wall 209, 211 thereby providing a perceived virtual sound source to the side of the user.

In the system of FIG. 2, the surround sound signals 205, 207 are however not conventional audio sound signals but are rather radiated as ultrasound signals. Thus, the system employs an ultrasound loudspeaker that radiates ultrasonic surround sound signals 205, 207.

Such ultrasound transducers have a highly directive sound beam. In general, the directivity (narrowness) of a loudspeaker depends on the size of the loudspeaker compared to the wavelengths. Audible sound has wavelengths ranging from a few inches to several feet, and because these wavelengths are comparable to the size of most loudspeakers, sound generally propagates omni-directionally. However, for an ultrasound transducer, the wavelength is much smaller and accordingly it is possible to create a sound source that is much larger than the radiated wavelengths thereby resulting in the formation of a very narrow and highly directional beam.

Such a highly directional beam can be controlled much better and in the system of FIG. 2 it can be directed to the listening position 111 via well defined reflections of the walls 209-213 of the room. The reflected sound will reach the ears giving the listener the perception of having sound sources located at the back of the room. Similarly, by directing the ultrasound beam to the side wall or ceiling, it is possible to generate perceived sound sources to the side and above the listener, respectively.

Thus, the system of FIG. 2 uses an ultrasound transducer that has a very directive sound beam as, or as part of, surround speakers 201, 203 that are located to the front of the listening position 111. This ultrasound beam can easily be directed to the side or back wall 209-213 of the room such that the reflected sound will reach the listener's ears to provide the perception of having sound sources placed at the back of the room.

The ultrasonic signals 205, 207 are specifically generated by amplitude modulating an ultrasound carrier signal by the audio signal of the surround channel. This modulated signal is then radiated from the surround speakers 201, 203. The ultrasound signal is not directly perceivable by a human listener but the modulating audio signal can automatically become audible without the need for any specific functionality, receiver or hearing device. In particular, any nonlinearity in the audio path from the transducer to the listener can act as a demodulator thereby recreating the original audio signal that was used to modulate the ultrasound carrier signal. Such a non-linearity may occur automatically in the transmission path. In particular, the air as a transmission medium inherently exhibits a non-linear characteristic that results in the ultrasound becoming audible. Thus, in the example, the non linear properties of the air itself cause the audio demodulation from a high intensity ultrasound signal. Thus, the ultrasonic signal may automatically be demodulated to provide the audio sound to the listener. Alternatively or additionally, the non-linearity may be provided by additional means. For example, a tone ultrasound signal may also be radiated to the listening position (e.g. from above to provide a relatively restricted listening zone). The mixing of the two ultrasonic signals can then result in a demodulation and recreation of the audio signal.

Examples and further description of the use of ultrasound transducers for audio radiation may for example be found in the PhD thesis "Sound from Ultrasound: The Parametric Array as an Audible Sound Source" by F. Joseph Pompei, 2002, Massachusetts Institute of Technology.

The use of an ultrasound radiation of the surround channels provides a very narrow beam. This allows for the reflections to be better defined and controlled and can in particular provide a more accurate control of the angle of arrival at the listening position. Thus, the approach may allow the virtual perceived position of the surround sound sources to be much better defined and controlled. Furthermore, the use of an ultrasound signal may allow such a position to be perceived to be closer to a point source, i.e. to be less smeared. Also, the narrow beam of an ultrasound transducer reduces the radiation of sound along other paths and specifically reduces the sound level of any sound reaching the listening position through a direct path.

Accordingly, the described approach provides for a substantially better defined virtual surround sound position to be perceived by the user. In particular, the spatial direction cues provided to the listener are substantially more accurate and are more homogenous and consistent with a sound source position behind (or to the side of the listener).

In the specific example, surround loudspeakers 201, 203 do not merely contain an ultrasound transducer or radiate only ultrasound signals. Rather, each of the surround loudspeakers 201, 203 comprise a speaker arrangement which includes both a directional ultrasound transducer for emitting ultrasound towards the walls 205, 207 as well as an audio range loudspeaker which radiates sound in the audio frequency range (say below 5-10 kHz).

In particular, the audio sound quality resulting from the use of such ultrasonic approaches is in some embodiments and scenarios not optimum as the process through which the ultrasonic carrier is demodulated to render the modulating audio signal audible tends to be inefficient and is inherently non linear. Ultrasonic loudspeakers therefore tend to produce a typically suboptimal sound quality and also tend to have low power handling capacity thereby making it difficult to produce high sound levels.

In the system of FIG. 2, this effect is mitigated by the ultrasound transducer being supplemented by an electro dynamical front-firing loudspeaker that further radiates some of the sound from the surround channel. This audio band signal radiation may reach the listening position 111 via a direct path. Thus, in addition to the reflected ultrasound signals 205, 207, the surround loudspeakers 201, 203 may also generate audio band signals 215, 217 which specifically may reach the listener by a direct path.

Thus, in the system, the sound of the left surround channel perceived by the listener at the listening position 111 is a combination of the demodulated ultrasonic signal 205 and the direct audio band signal 215. Similarly, the sound of the right surround channel perceived by the listener at the listening position is a combination of the demodulated ultrasonic signal 207 and the direct audio band signal 217.

The use of the audio range loudspeaker to supplement the directional ultrasound transducer provides an improved sound quality in many embodiments. In particular, it may provide an improved sound quality at lower frequencies. Such lower frequencies may typically not provide as many spatial cues as higher frequencies and therefore the listener may still perceive the surround sound to arrive from the rear, i.e. may still perceive that there are virtual sound sources to the rear.

However, in the specific embodiment of FIG. 2, the surround sound signal radiated from the audio range loudspeaker is furthermore delayed relative to the surround sound signal radiated from the directional ultrasound transducer. Thus, in the example, a delay of the sound of the audio range loudspeaker relative to the ultrasonic signal is introduced to ensure that the perception of the sound arriving only from the direction of the reflected ultrasound beam can be maintained.

This approach is based on the psycho acoustic phenomenon known as the so-called "precedence effect" (also referred to as the "Haas effect" or the "law of the first wavefront"). This phenomenon indicates that when the same sound signal is received from two sources at different positions and with a sufficiently small delay, the sound is perceived to come only from the direction of the sound source that is ahead, i.e. from the first arriving signal. Thus, the psychoacoustic phenomenon refers to the fact that the human brain derives most spatial cues from the first received signal components.

Hence, the result of supplementing the directional ultrasound transducer by a co-operating audio range loudspeaker is that a convincing, robust perception of a sound source at the location of the reflection is achieved while at the same time providing a high quality sound as is typically associated with conventional loudspeaker.

In some embodiments, the directional ultrasound transducer and the classical loudspeaker may reproduce identical audio components of the radiated signals, i.e. the unprocessed surround sound input signal (except for the delay applied for the audio range loudspeaker) may be radiated from both sources. In other embodiments, the directional ultrasound transducer and the audio range loudspeaker may e.g. reproduce different, possibly overlapping, parts of the frequency range of the input signal, so as to further improve the robustness of the spatial illusion.

Figure 3:
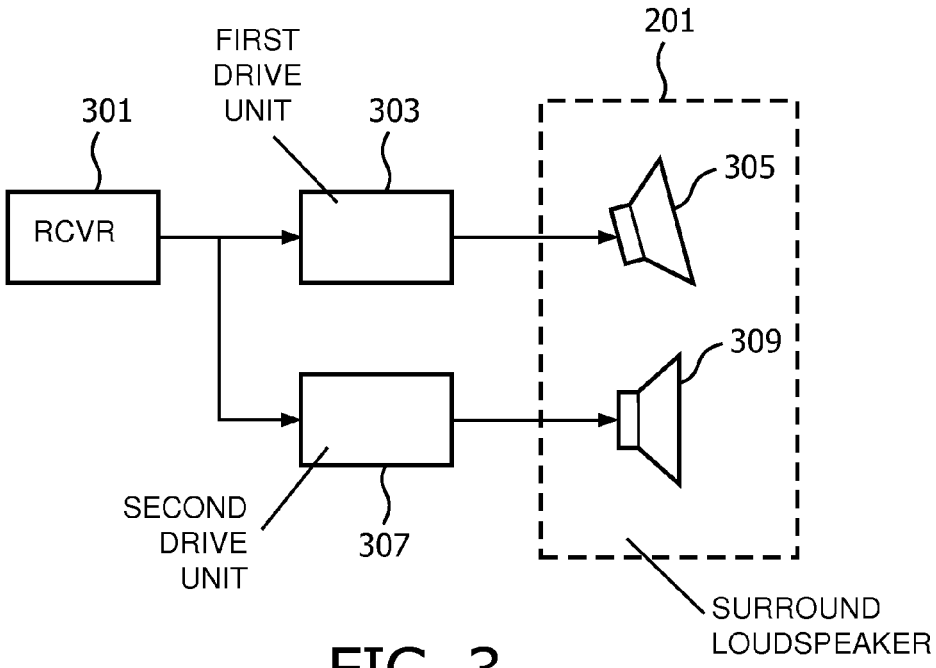
FIG. 3 is an illustration of an example of elements of a surround sound system in accordance with the invention.

FIG. 3 illustrates an example of a surround speaker arrangement and associated driving functionality in accordance with some embodiments of the invention. For clarity and brevity, the example will be described with reference to the left surround channel of the example of FIG. 3 However, it will be appreciated that the example and principles are equally applicable to the right surround channel or indeed to any surround channel.

FIG. 3 illustrates a receiver 301 which receives a multi-channel spatial signal, such as a 5.1 surround signal. The multi-channel spatial signal may for example be a collection of analog signals, with one audio signal for each channel, or may be a digitally encoded multi-channel spatial signal. In the latter case, the multi-channel spatial signal may be encoded and the receiver 301 may be arranged to decode the signal.

It will be appreciated that the multi-channel spatial signal may be received from any suitable source, such as an external or internal source.

The multi-channel spatial signal comprises at least one surround channel. In particular, the multi-channel spatial signal comprises one or more front channels (in the specific example three front channels) which are intended to be presented to the listener from a forward direction. In addition at least one surround channel is included which is associated with a sound source position to the side or rear of the listener. Thus, the surround channel is associated with a sound source position that is not a front position, and specifically is outside the angle provided by the left(most) and right(most) front speakers. In the specific example, the multi-channel spatial signal comprises two surround channels, namely a left rear channel and a right rear channel.

FIG. 3 further illustrates the processing of one of the surround channels. In particular, FIG. 3 illustrates elements of the functionality associated with the left rear speaker position.

The receiver 301 is coupled to a first drive unit 303 which is coupled to a directional ultrasound transducer 305 and which is able to generate a drive signal therefor. In addition, the receiver 301 is coupled to a second drive unit 307 which is coupled to an audio range loudspeaker 309 and which is able to generate a drive signal therefor. Thus, in the example, the received left rear surround channel signal is fed to the first drive circuit 303 and the second drive circuit 307. The drive circuits 303, 307 drive respectively the directional ultrasound transducer 305 and the audio range loudspeaker 309 such that the left rear surround channel is radiated from both the directional ultrasound transducer 305 and the audio range loudspeaker 309, i.e. as both an ultrasound signal and an audio signal.

In some embodiments, the first drive circuit 303 may simply comprise an ultrasound modulator that modulates the left rear audio signal onto an ultrasound carrier frequency followed by a power amplifier that amplifies the signal to a suitable level for the directional ultrasound transducer 305 to generate the appropriate sound output level. In typical applications the ultrasound carrier frequency is above 20 kHz (e.g. around 40 kHz) and the sound pressure level is above 110 dB (often around 130-140 dB).

The second drive circuit 307 may simply comprise a suitable power amplifier that directly drives the audio range loudspeaker 309.

Thus, essentially the same audio signal may be fed to the directional ultrasound transducer 305 and the audio range loudspeaker 309. In particular, the correlation between the audio signal components of the output signals of the first drive circuit 303 and the audio range loudspeaker 309 may be quite high, and in particular the energy normalized correlation may be above 0.5. In scenarios wherein the audio signals from the two drive circuits 303, 307 are delayed relative to each other, the correlation may be determined after a compensation for such a delay. The correlation may specifically be determined as the maximum correlation between the audio signals of the drive signals from the two drive circuits 303, 307.

However, in other embodiments, the first drive circuit 303 and/or the second drive circuit 307 may include processing which results in the audio signal components being differently processed in the two paths. In particular, as previously mentioned, the audio signal for the audio range loudspeaker 309 may be delayed and/or filtered.

Figure 4:
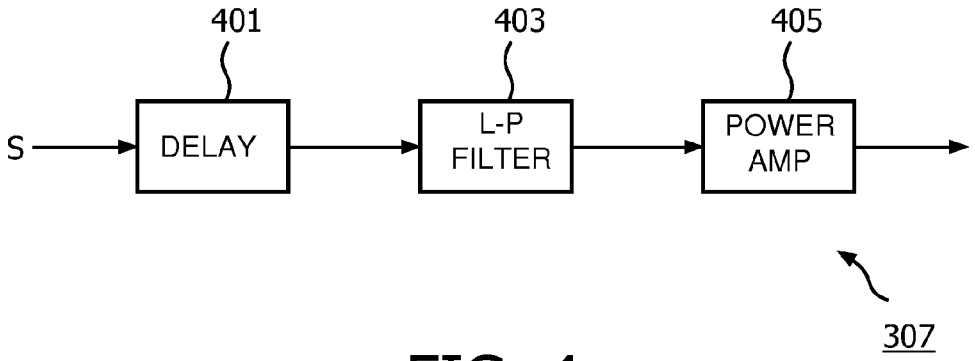
FIG. 4 is an illustration of an example of elements of a drive circuit of a surround sound system in accordance with the invention.

FIG. 4 specifically illustrates an example of the second drive circuit 307 which comprises both delaying and a filtering operations. In the example, surround signal is first delayed in a delay 401 and then filtered in a low pass filter 403. The delayed and low pass filtered audio signal is then fed to a power amplifier 405 which amplifies the signal to a suitable level for the audio range loudspeaker 309.

Thus, in the example, a delay is added to the signal for the audio range loudspeaker 309 in order to ensure that the listener perceives all, or most, of the sound to originate from the direction of the reflected sound beam 205 and not from the direction of the audio signal 215 from the audio range loudspeaker 309. The result is a convincing, robust perception of a sound source at the location of the reflection from the rear wall 213 but with the improved sound quality of the audio range loudspeaker 309.

This precedence (or Haas) effect occurs when two loudspeakers radiate the same signal but with one signal being received with short delay relative to the other. The effect generally occurs for a relative delay in the range from about 1 ms to an upper limit of typically 5-40 ms. In such a situation, the sound is perceived to be arriving from the direction of the undelayed loudspeaker. The upper limit strongly depends on the type of signal. The lowest value of about 5 ms is valid for very short, click- or pulse-like sounds, while high values of up to 40 ms occur for speech. If the delay is increased above the upper limit, the perceptual fusion of the sound sources at the position of the undelayed source does no longer occur, and the two sources are perceived separately (echo). If, on the other hand, the delay is smaller than the lower limit of the precedence effect (about 1 ms) "summing localization" occurs and a single sound source is perceived at a position between the two sources.

In the example, the delay is set such that the signal from the directional ultrasound transducer 305 is received slightly before the signal from the audio range loudspeaker 309.

In order to achieve an optimum precedence effect, the delay must be set very carefully and in particular a delay $\tau$ has to be applied in the second drive circuit 307 which comprises two components. The first delay component $\tau t_1$ compensates for the travel time difference due to the different path lengths to the listener's ears for sound waves originating from the directional ultrasound transducer 305 and the audio range loudspeaker 309 respectively. As is clear from FIG. 2, the transmission path delay corresponds to the distance from the directional ultrasound transducer 305 to the reflection point on the side wall 209 ($D_{U1}$) plus the distance from the reflection point on the rear wall 213 to the reflection point on the side wall 209 ($D_{U2}$) plus the distance from the reflection point on the rear wall 213 to the listening position 111 ($D_{U3}$). The distance difference can then be found by subtracting the path length from the audio range loudspeaker 309 to the listening position 111 ($D_C$). This distance difference is thus $D_{U1}+D_{U2}+D_{U3}-D_C$, and so to compensate this, a delay is required of $\tau t_1=(D_{U1}+D_{U2}+D_{U3}-D_C)/c$ seconds (with c being the speed of sound).

Applying this delay results in the reflected sound from the directional ultrasound transducer 305 and the direct sound from the audio range loudspeaker 309 arriving at the same time at the listener's ears. In addition to this compensating delay, an additional delay component $\tau t_2$ is required for the precedence effect to be achieved. The total delay applied to the signal of the audio range loudspeaker 309 is thus $\tau=\tau t_1+\tau t_2$.

As previously mentioned, the value of $\tau t_2$ is not very critical, as long as it is between 1 ms and the upper limit of the precedence effect, which depends on the signal type.

For the most critical type of signal, short clicks, the upper limit for $\tau t_2$ is 5 ms, and therefore it may in some scenarios be advantageous to select the delay $\tau t_2$ in the range of 1-5 ms. Such a delay may for example be used in scenarios wherein it is possible to carefully set up a configuration wherein the transmission path delay is well known and static.

However, the required value for the compensating delay $\tau t_1$ (the transmission path delay) is very dependent on the geometrical lay-out of the room, the loudspeaker placement and the listening position, and is in typical configurations in the range of a few to several tens of milliseconds (say, 3-30 ms). This means that with a small value of $\tau t_2$ between 1-5 ms, the total required delay $\tau$ is very much determined by the exact value of $\tau t_1$, and it is necessary to set the value of $\tau t_1$ carefully to correspond to the actual geometrical configuration.

In some embodiments, the delay 401 may accordingly be a delay which can be varied in response to the transmission path delay value for the transmission path from the directional ultrasound transducer 305 to the listening position 111. The transmission path delay value for the directional ultrasound transducer 305 may be reduced by the transmission path delay value for the transmission path from the audio range loudspeaker 309 to the listening position 111 thereby generating a transmission path delay difference value which is used to offset for the path variation.

The transmission path delay compensation may be performed manually by a user e.g. manually setting the relative transmission path delay $\tau t_1$. This setting may e.g. be based on a measurement of the two physical path lengths by the user, or by having the user manually adjust a delay control until the desired effect is perceived.

As another example, a microphone may be placed in the listening position 111 and coupled to the drive functionality. A measurement signal from the microphone may then be used to adapt the delay 401 such that it compensates for both the transmission path delay difference and provides the desired precedence effect. For example, a ranging distance measurement process may be performed by radiating calibration signals from the directional ultrasound transducer 305 and the audio range loudspeaker 309.

Thus, in the described example the system is arranged to introduce a delay which is no more than 40 msec higher than a transmission path delay difference between a transmission path from the directional ultrasound transducer 305 to a listening position 111 and a path from the audio range loudspeaker 309 to the listening position 111. Indeed, in many embodiments, the delay is advantageously no more than 15 msec or even 5 msec higher than this transmission path delay difference. Indeed, this may be achieved by a calibration and adaptation of the system based on a determination of the transmission path delay difference and/or may be achieved by controlling the location of speakers for the specific room characteristics.

In order to make the system less sensitive to the actual geometrical configuration and ensure robust localization in the direction of the reflected sound of the directional ultrasound transducer 305 in a large range of use cases, it may in some embodiments be preferred to set the value of $\tau t_2$ relatively high. An advantage of this approach in many scenarios is that in most cases there will then be no need to set the delay $\tau t_1$ according to the specific configuration, i.e. the same delay will be suitable for relatively high variations in the transmission path delay difference. However, since $\tau t_2$ may be set higher than 5 ms, the precedence effect may no longer work perfectly for very short signals, such as transients in percussive music.

However, in the example, the second drive circuit 307 also comprises a low pass filter 403 that low pass filters the audio band signal before this being fed to the audio range loudspeaker 309. Thus, in the example, the audio range loudspeaker 309 is predominantly used to reproduce the lower part of the frequency spectrum of the surround signal whereas the high frequency part of the spectrum including transients is predominantly reproduced by the directional ultrasound transducer 306.

Thus, in the example, the pass-bands for the first drive circuit 303 and the second drive circuit 305 are different.

The cut-off frequency of the low-pass filter 403 may be set sufficiently low to effectively filter out transients from the sound radiated from the audio range loudspeaker 309 thereby relaxing the delay requirement for the precedence effect. However, it may further be set sufficiently high to ensure that there is not a gap between the highest frequency that is effectively reproduced by the audio range loudspeaker 309 and the lowest frequency effectively reproduced by the directional ultrasound transducer 305. Indeed, as ultrasound transducers often have poor low-frequency response, the cut-off frequency may be effectively set to ensure a smooth cross-over.

Practical experiments have demonstrated that in a typical living-room configuration and with various types of music as input signals, very satisfying results may be achieved with a value of $\tau t_2$ of 10 ms and a low-pass cut-off frequency of 800 Hz.

In some embodiments, the cross-over between the directional ultrasound transducer 305 and the audio range loudspeaker 309 may be controlled by an appropriate design of the low pass filter based on known characteristics of the directional ultrasound transducer 305 and the audio range loudspeaker 309, i.e. a static cross-over performance may be designed.

However, as the cross-over perceived at the listening position may depend on variations in these characteristics as well as characteristics of the specific environment, the cross-over may in some embodiments be adapted based on a feedback mechanism.

For example, a measurement signal from a microphone located at the listening position 111 may be used to adapt the cross-over. Specifically, the signal level for the directional ultrasound transducer 305 relative to the audio range loudspeaker 309 may be adjusted based on the microphone signal. Alternatively or additionally, the cut-off frequency of the low pass filter 403 may be adjusted.

As an example, the second drive unit 307 may receive the microphone signal. It may analyze this to determine a signal level in a frequency interval below the cut-off frequency (e.g. 500 Hz-700 Hz) and a signal level in a frequency interval above the cut-off frequency (e.g. 900 Hz-1100 Hz). If the signal level at the lower frequency interval is lower than the frequency interval at the higher frequency interval, the amplification of the power amplifier 405 and/or the cut-off of the low pass filter 403 may be increased resulting in an increased signal level from the audio range loudspeaker 309. Conversely, if the signal level at the lower frequency interval is higher than the frequency interval at the higher frequency interval, the amplification of the power amplifier 405 and/or the cut-off of the low pass filter 403 may be decreased resulting in a decreased signal level from the audio range loudspeaker 309.

In some embodiments, the delay provided by the delay 401 may be set to result in a perceived spatial sound source position that does not correspond to the direction of arrival of the reflected signal but rather corresponds to a position in between this position and the position of the audio range loudspeaker 309. Specifically, a sound source position value may be provided which indicates a desired position between these points, and the second drive unit 307 may proceed to set the delay accordingly.

This can specifically be achieved by setting the delay $\tau t_2$ to a value between 0 and 1 ms. In this case a "summing localization" perception will result rather than the precedence effect. This results in a source being perceived between the directions of the reflected ultrasound beam and audio range loudspeaker 309. Therefore, by controlling the delay, the position of the perceived virtual source can be controlled in a similar way to conventional stereo reproduction. Such embodiments preferably involve an accurate estimation or determination of the transmission path delay difference in order to ensure correct setting of the delay.

It should be noted that it is not obvious from current knowledge that the precedence effect will work in a situation where the delayed and un-delayed loudspeakers reproduce different portions of the frequency spectrum of a signal. Rather, the psychoacoustic teaching of the precedence effect is restricted to the situation wherein the same signal is radiated from two sources. However, practical experiments have been performed with almost no overlap between the frequency intervals reproduced by the directional ultrasound transducer 305 and the audio range loudspeaker 309. These experiments have demonstrated that the precedence effect also works if two sources reproduce signals that have different frequency content but share the same envelope modulation or similar overall temporal signal characteristics.

In the example, the audio range loudspeaker 309 and the directional ultrasound transducer 305 are arranged at an angle to each other, i.e. their on-axis directions or main firing directions are at an angle to each other. This may provide improved performance in many scenarios and may in particular allow the directional ultrasound transducer 305 to radiate a signal directly to a side wall while allowing the audio range loudspeaker 309 to be aimed directly at the listening position 111. Thus, the surround speaker 201 can be calibrated for optimal sound reproduction in different acoustic environments thereby providing improved audio quality and/or an improved spatial experience.

In some embodiments, the on-axis direction of the directional ultrasound transducer 305 may be varied relative to the on-axis direction of the audio range loudspeaker 309. In some embodiments, such a variation may be provided manually. For example, the listener may be provided with means for directing the angle of the directional ultrasound transducer 305 such that the ultrasonic sound beam can be directed towards the side wall reflection point that provides the optimum reflections for reaching the listening position.

In some embodiments, the direction of at least one of the directional ultrasound transducer 305 and the audio range loudspeaker 309 may be set by a feedback calibration loop. For example, the driving unit may be coupled to a microphone at the listening position 111 and may receive the measured signal therefrom. This may be used to adjust the angle of the directional ultrasound transducer 305 and thus the reflection points on the walls 209, 213. A calibration signal may then be fed to the directional ultrasound transducer 305 (with all other speakers being silent) and the direction of the ultrasonic beam can be adjusted until it provides the highest signal level measured by the microphone.

The direction of the ultrasonic beam can be altered electronically (e.g. using beam forming techniques) or e.g. by mounting the directional ultrasound transducer 305 on a hinged mechanism that can be adjusted manually or driven by servo motors.

In the example of FIG. 2, each spatial channel is radiated by its own individual speaker. However, as illustrated in FIG. 2, the described approach allows for an effective surround experience while allowing the surround speakers 201, 203 to be located to the front of the user and in particular co-located or adjacent to one of the front speakers 101, 103, 105. However, this further allows the same speaker to be used to render more than one of the spatial channels. Thus, in many embodiments, the surround speakers 201, 203 may also be used to render one of the front channels.

In the specific example, the left surround speaker 201 may also render the left front channel and the right surround speaker 203 may also render the right front channel. However, as the left and right front channels should be provided directly to the listening position (via a direct path) such that they appear to come from the front, i.e. directly from the speaker position, the front channel is only rendered from the audio range loudspeaker 309 and not from the directional ultrasound transducer 305.

Figure 5:
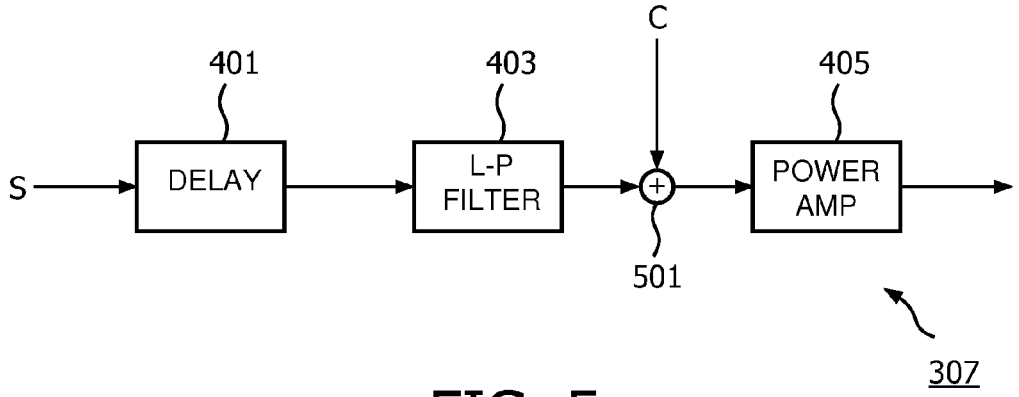
FIG. 5 is an illustration of an example of elements of a drive circuit of a surround sound system in accordance with the invention.

This may in particular be achieved by the drive signal for the audio range loudspeaker 309 being generated not only from the signal of the left surround channel but also from the left front channel. FIG. 5 specifically illustrates how the second drive unit 307 of FIG. 4 may be modified to include a combiner 501 which combines the delayed and low pass filtered left surround signal with the left front signal. In the example, the combiner 501 is inserted between the low pass filter 403 and the power amplifier 405.

Figure 6:
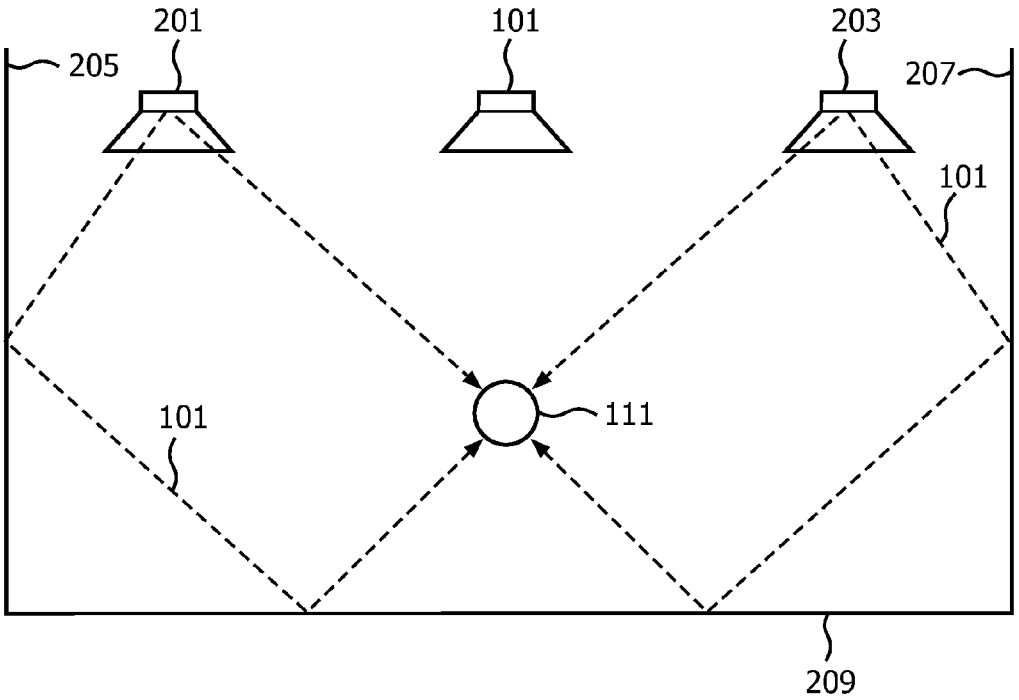
FIG. 6 is an illustration of an example of speaker system setup for a surround sound system in accordance with the invention.

Thus, accordingly, the left front speaker 103 and the right front speakers 105 can be removed and instead the audio range loudspeaker 309 of the left surround speaker 201 and the audio range loudspeaker 309 of the right surround speaker 203 can be used resulting in the system of FIG. 6.

Thus, a very significant advantage of the described approach is that it not only allows surround sounds to be produced by forward positioned speakers but also that it allows for a reduction in the total number of speakers needed.

Alternatively or additionally, the surround speakers 203, 205 may also be used for the center channel. For example, instead of (or in some scenarios as well as) the left front channel being fed to the combiner 501, the center channel may be fed to it. Thus, the audio range loudspeaker 309 of the left surround speaker 203 may also be used to radiate the center channel. The center channel may likewise be fed to the combiner 501 for the right surround speaker 205 to provide a centrally perceived sound source location for the center channel signal being radiated by the left and right surround speakers 203, 205.

Indeed, in some embodiments, the system may provide a spatial surround sound using only the surround speakers 203, 205, and in particular the surround speakers 203, 205 may be used to recreate both a left and right surround channel, a left and right front channel, and a center channel.

In some embodiments, the first drive unit 301 may be arranged to generate the drive signal in response to a characteristic of a signal of at least one other channel of the multi-channel spatial signal than the at least one surround channel which is rendered by the directional ultrasound transducer 305. Specifically, the drive signal may be generated in response to a signal level of one or more of these other channels.

Indeed, in many scenarios it is not possible or desirable to produce very high sound levels using an ultrasound loudspeaker. This may e.g. be limited by regulations on ultrasound exposure or by practical implementation constraints. Also the subjective effect of ultrasound may depend on the total time of exposure which accordingly may advantageously be limited. Therefore, in some embodiments, the first drive signal may be generated to take into account the sound pressure level produced by other audio channels of the multi-channel spatial signal. Accordingly, the ultrasound generated by the directional ultrasound transducer may be limited to times in which the signal level in one or more of the other channels meets a criterion. Specifically, the directional ultrasound transducer may only be used at times when the overall audio level is low thereby ensuring that the directional ultrasound transducer is restricted to provide a safe exposure level to the listener. In particular, sequences with low overall sound pressure level and distinct surround audio effects are common in audio for movies and the described approach may e.g. be particularly suitable for Home Cinema Systems.

Directional ultrasound transducers 305s have inherently low efficiency and a poor low frequency response. The governing nonlinear process by which sound is generated can be approximated by Berktay's (Berktay, H. O. (1965). Possible exploitation of non-linear acoustics in underwater transmitting applications. *J. Sound Vib.*, (2), 435-461) far field approximation which states that the audible sound is proportional to the second derivative of the square of the modulation envelope $$y(t) = \frac{\partial^2}{\partial t^2}(E(t))^2,$$

where y(t) is the audio signal and E(t) is the modulation envelope. E(t) is a function of the audio signal to be reproduced. The second order differential term introduces a frequency dependent gain function proportional to $f^2$, where f is the frequency. This gain function means that for every doubling in frequency the efficiency of the ultrasonic loudspeaker increases by 12 dB.

To provide high quality audio from a directional ultrasound transducer 305 an equalization function must be applied to provide a balanced frequency response. To equalize the inherent $f^2$ dependency, a filter can be applied to the input signal with a $$\frac{1}{f^2}$$

relationship. This filter is equivalent to a low pass filter with a 12 dB slope.

The choice of −3 dB point (cut off frequency) for this low pass equalization filter determines the maximum achievable audio output Sound Pressure Level (SPL) for the directional ultrasound transducer. All things being equal, a directional ultrasound transducer with cut off frequency at 2000 Hz can play 12 dB louder than a directional ultrasound transducer with cut off frequency at 1000 Hz.

As described in the invention, an audio range loudspeaker 309 is used to provide the mid/low frequencies below this cut-off frequency. Ideally the low frequency cut-off point will be chosen to be at as low a frequency as possible. This means the directional ultrasound transducer provides more audio cues for localization purposes and the localization cues produced by the audio range loudspeaker are minimized. On the other hand, at low frequencies the audio output of the directional ultrasound transducer is low, limiting the maximum output SPL of the system.

A typical directional ultrasound transducer may be capable of a maximum audio output of around 70 dB at 1000 Hz. For home cinema sound reproduction 70 dB may not be sufficient to create an immersive and embracing effect. To be useful for home cinema sound reproduction the maximum amplitude may need to be increased.

It is not possible to simply increase the SPL of the directional ultrasound transducer as this would quickly exceed the operating limits of the transducer and electronics resulting in severe distortion, and the possible transmission of dangerous levels of ultrasound. To achieve higher subjective amplitude a dynamic gain function can be used. The dynamic gain function automatically changes the low frequency cut off of the directional ultrasound transducer equalization filter and the cut off frequency of the low pass filter 403 applied to the audio range loudspeaker based on the instantaneous audio SPL requirements. Thus based on the incoming audio signal the −3 dB points of both filters are automatically adjusted such that the necessary SPL is reached. In the most basic implementation the low frequency cut off of the directional ultrasound transducer and the −3 dB frequency of the low pass filter 403 for the audio range loudspeaker are the same and can be referred to as the crossover frequency.

Figure 7A:
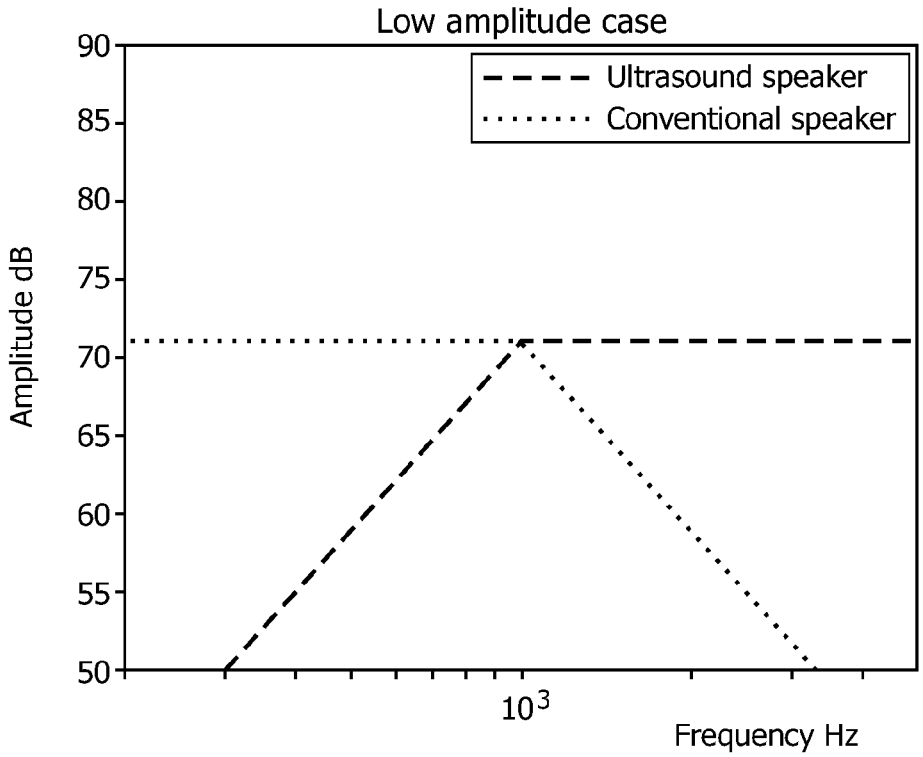
FIG. 7A is an illustration of an example of a frequency domain diagram of a dynamic gain function for which at low amplitudes a cross-over frequency is chosen to be as low as possible.

For example, when the signal to be rendered is of low amplitude, the crossover frequency can be chosen to be as low as possible, see FIG. 7A. This selection maximizes the audio cues from the directional ultrasound transducer reflection point, providing a strong auditory illusion. If the amplitude of the signal to be rendered exceeds the maximum SPL capacity of the directional ultrasound transducer at a given crossover frequency, the crossover frequency can be increased to take advantage of the improved efficiency of the directional ultrasound transducer at higher frequencies, see FIG. 7B. This selection enables higher audio SPL output and lower distortion, but slightly reduces the strength of the auditory illusion. The dynamic gain function thus trades the strength of the audio illusion against the maximum system SPL.

Figure 7B:
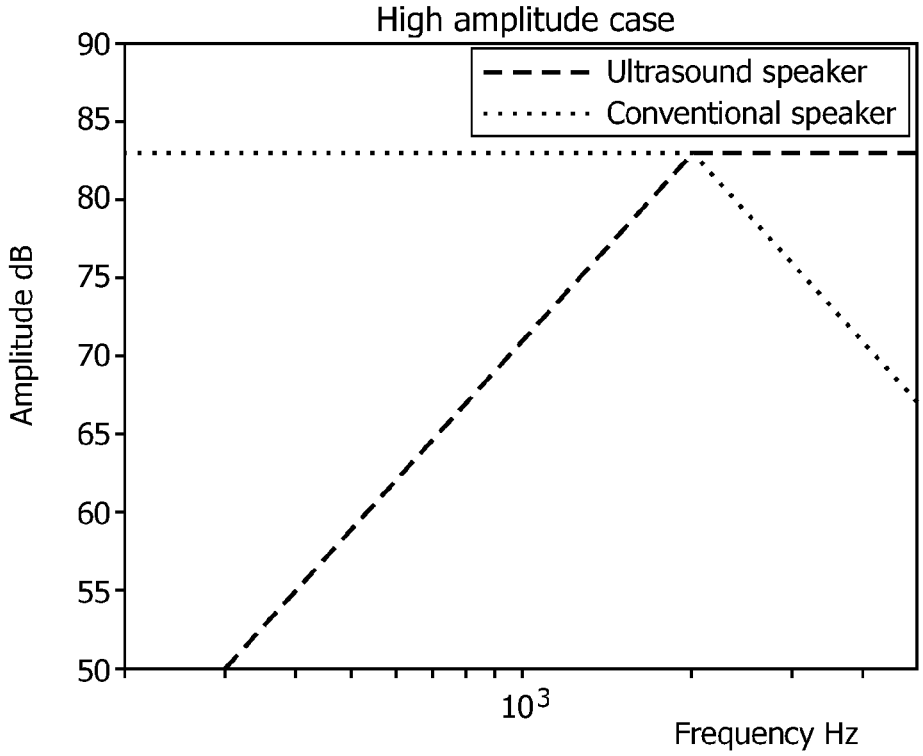
FIG. 7B is an illustration of an example of a frequency domain diagram of a dynamic gain function for which a cross-over frequency is increased to allow higher output SPL.
Figure 8A:
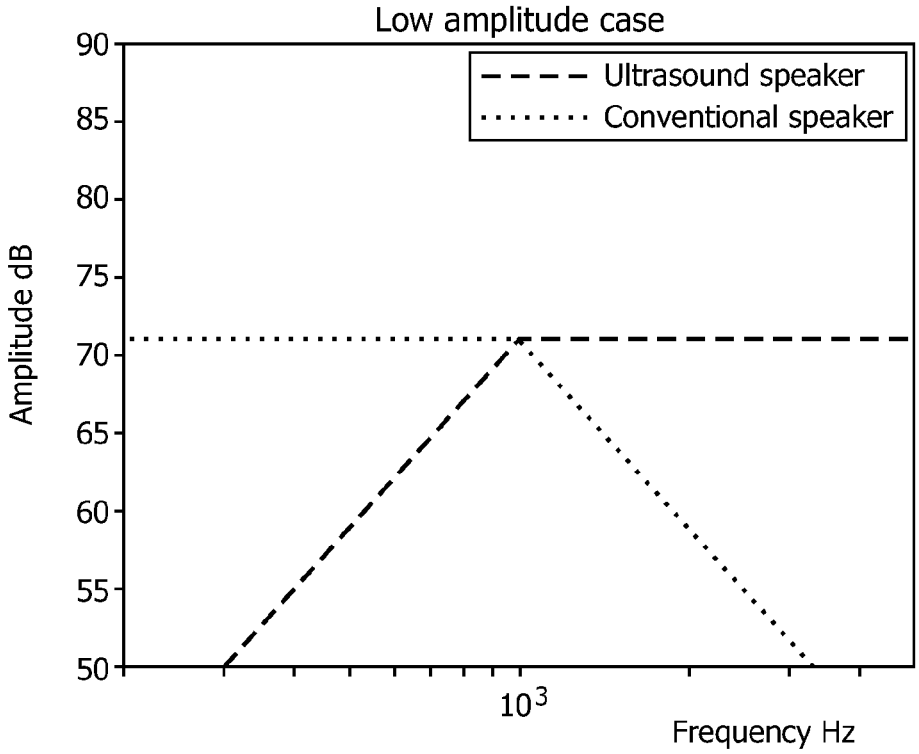
FIG. 8A is an illustration of a frequency domain representation of an example method of creating a psycho-acoustically optimal dynamic gain for a low amplitude setting.
Figure 8B:
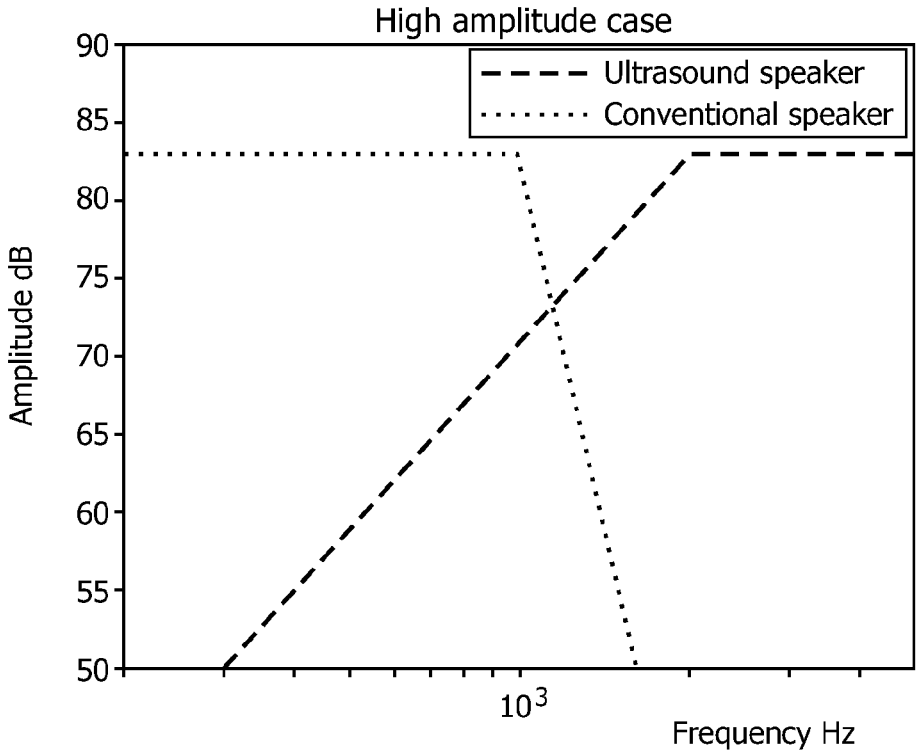
FIG. 8B is an illustration of a frequency domain representation of an example method of creating a psycho-acoustically optimal dynamic gain for a high amplitude setting.

It should be noted that "ultrasound speaker" and "conventional speaker" used in the legend of FIG. 7A and FIG. 7B are the directional ultrasound transducer and the audio range loudspeaker, respectively. The same holds for FIG. 8A and FIG. 8B.

A relationship defining the instantaneous crossover frequency and system SPL can be constructed from the $f^2$ dependence in Berktay's formula. If $P_{1000}$ is the maximum undistorted audio SPL (in Pascal) an ultrasonic loudspeaker can achieve at 1000 Hz, and the $P_{sig}$ is the required instantaneous SPL (in Pascal), the crossover point $f_c$ is $$f_c = 1000\sqrt{\frac{P_{sig}}{P_{1000}}}.$$

In the embodiment described above as the crossover frequency is increased, the relative strength of the directional audio cues projected from the directional ultrasound transducer decrease whilst the unwanted directional cues from the audio range loudspeaker increase. The result is a weaker audio illusion. To maximize performance the low frequency cut off of the directional ultrasound transducer equalization filter and the cut off frequency of the low pass filter for the audio range loudspeaker can be independently controlled based on a psycho acoustically optimized system. This surround sound system would limit the energy transmitted by the low frequency loudspeaker over a critical range of frequencies, say from 800 Hz to 2000 Hz. In this way the relative strength of the directional audio cues projected by the directional ultrasound transducer are maintained over this critical frequency band at the expense of a flat frequency response, see FIG. 8A and FIG. 8B. Now the dynamic gain function can trade maximum amplitude against flat frequency response and the strength of the auditory illusion is little affected. The exact nature of the dynamic gain function is then determined by a psycho acoustical weighting function optimized to maximize the illusion strength at all audio output levels.

The choice of dynamic gain function can be application-dependent. For example, for HiFi applications a flat frequency response may be considered the most important factor and the basic dynamic gain scheme could be employed. For home cinema applications achieving strong localization cues from the rear may be considered the most important factor. In this case the psycho-acoustically optimized dynamic gain function would be most suitable.

Figure 9:
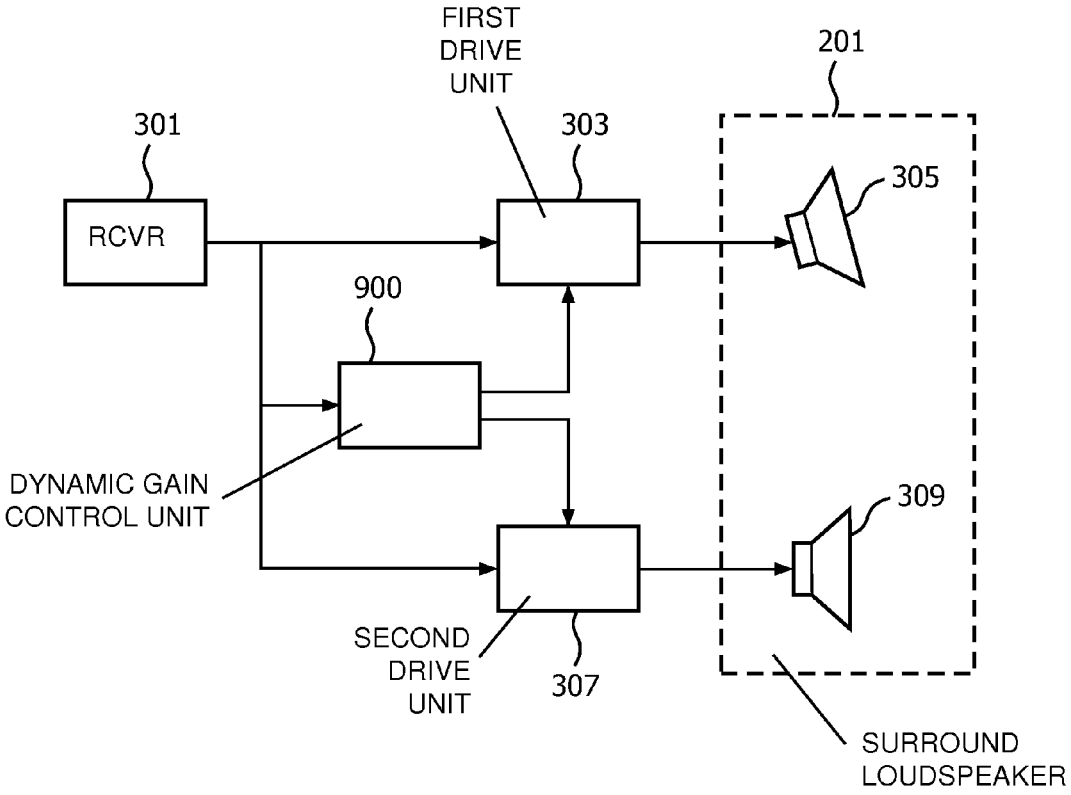
FIG. 9 is an illustration of an example of elements of a surround sound system with a dynamic gain function in accordance with the invention.

FIG. 9 shows an example architecture of the surround sound system with the dynamic gain function according to the invention. This architecture is the architecture of FIG. 2 that additionally comprises a dynamic gain control unit 900. Said unit 900 adjusts the cross-over frequency based on the maximum SPL as discussed above. The cross-over frequency is passed to the first drive circuit 303 and the second drive circuit 307.

It will be appreciated that the above description for clarity has described embodiments of the invention with reference to different functional circuits, units and processors. However, it will be apparent that any suitable distribution of functionality between different functional circuits, units or processors may be used without detracting from the invention. For example, functionality illustrated to be performed by separate processors or controllers may be performed by the same processor or controllers. Hence, references to specific functional units or circuits are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units, circuits and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements, circuits or method steps may be implemented by e.g. a single circuit, unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. A surround sound system comprising:

a circuit for receiving a multi-channel spatial signal comprising at least one surround channel;

a directional ultrasound transducer for emitting ultrasound towards a surface to reach a listening position via a first longer path, including a reflection from the surface;

a first drive circuit for generating a first drive signal for the directional ultrasound transducer from a surround signal of the surround channel;

an audio range loudspeaker for emitting sound to reach the listening position via a second shorter path;

a second drive circuit for generating a second drive signal for the audio range loudspeaker from the surround signal; and a delay circuit for introducing a delay of a second signal component of the second drive signal originating from the surround signal relative to a first signal component of the first drive signal originating from the surround signal, said delay having a value that effects arrival at the listening position of surround sound from the first signal component before arrival of correlating surround sound from the second signal component and establishes a perceived direction of said arriving sounds as being from a position where the surround sound from the first signal component was reflected toward the listening position.

2. The surround sound system of claim 1, wherein the delay is no more than 40 msec higher than a transmission path delay difference between a transmission path from the directional ultrasound transducer to the listening position and a direct path from the audio range loudspeaker to the listening position.

3. The surround sound system of claim 1 wherein the delay circuit is arranged to vary the delay in response to a transmission path delay value, the transmission path delay value being indicative of a delay of a transmission path from the directional ultrasound transducer to the listening position.

4. The surround sound system of claim 1 wherein the delay circuit is arranged to vary the delay in response to a sound source position value.

5. The surround sound system of claim 1 wherein a first pass-band frequency interval for generating the first drive signal from the surround signal is different than a second pass-band for generating the second drive signal from the surround signal.

6. The surround sound system of claim 5 wherein an upper cut-off frequency for the first pass-band is higher than an upper cut-off frequency for the second pass-band.

7. The surround sound system of claim 1 wherein the second drive circuit comprises a low pass filter.

8. The surround sound system of claim 1 wherein the second drive circuit is adapted to generate the second drive signal from a front channel of the multi-channel spatial signal.

9. The surround sound system of claim 1 further comprising a circuit for varying an on-axis direction of the directional ultrasound transducer relative to an on-axis direction of the audio range loudspeaker.

10. The surround sound system of claim 1 where the directional ultrasound transducer and the audio range loudspeaker are included in a common surround loudspeaker.

11. The surround sound system of claim 1 where the second drive circuit is adapted to generate a combined audio signal for driving the audio range loudspeaker, said combined audio signal comprising:

the delayed second signal component of the second drive signal originating from the surround signal; and a non-surround front channel drive signal;

thereby utilizing a common audio loudspeaker to provide both surround and non-surround audio.

12. A surround sound system comprising:

a circuit for receiving a multi-channel spatial signal comprising at least one surround channel;

a directional ultrasound transducer for emitting ultrasound towards a surface to reach a listening position via a reflection from the surface;

a first drive circuit for generating a first drive signal for the directional ultrasound transducer from a surround signal of the surround channel;

an audio range loudspeaker;

a second drive circuit for generating a second drive signal for the audio range loudspeaker from the surround signal; and a circuit for receiving a measurement signal from a microphone disposed at a predetermined position relative to the ultrasound transducer and the loudspeaker; and a circuit for adjusting a level of a second signal component of the second drive signal originating from the surround signal relative to a first signal component of the first drive signal originating from the surround signal in response to the measurement signal.

13. A surround sound system comprising:

a circuit for receiving a multi-channel spatial signal comprising at least one surround channel;

a directional ultrasound transducer for emitting ultrasound towards a surface to reach a listening position via a reflection from the surface;

a first drive circuit for generating a first drive signal for the directional ultrasound transducer from a surround signal of the surround channel;

an audio range loudspeaker;

a second drive circuit for generating a second drive signal for the audio range loudspeaker from the surround signal;

wherein a normalized delay compensated correlation of a second signal component of the second drive signal originating from the surround signal and a first audio signal component of the first drive signal originating from the surround signal is not less than 0.50.

14. A surround sound system comprising:

a circuit for receiving a multi-channel spatial signal comprising at least one surround channel;

a directional ultrasound transducer for emitting ultrasound towards a surface to reach a listening position via a reflection from the surface;

a first drive circuit for generating a first drive signal for the directional ultrasound transducer from a surround signal of the surround channel;

a circuit for receiving a measurement signal from a microphone disposed at a predetermined position relative to the ultrasound transducer and the loudspeaker; and a circuit for adjusting an on-axis direction of the directional ultrasound transducer in response to the measurement signal.

15. A method of operating a surround sound system comprising a directional ultrasound transducer for emitting ultrasound towards a surface to reach a listening position via a first longer path including reflection from the surface, and an audio range speaker for emitting sound to reach the listening position via a second shorter path, the method comprising:

receiving a multi-channel spatial signal comprising at least one surround channel; and generating a first drive signal for the directional ultrasound transducer from a surround signal of the surround channel;

generating a second drive signal for the audio range loudspeaker from the surround signal; and introducing a delay of a second signal component of the second drive signal originating from the surround signal relative to a first signal component of the first drive signal originating from the surround signal, said delay having a value that effects arrival at the listening position of surround sound from the first signal component before arrival of correlating surround sound from the second signal component and establishes a perceived direction of said arriving sounds as being from a position where the surround sound from the first signal component was reflected toward the listening position.

* * * * *